United States Patent [19]

Shaw et al.

[11] 4,264,333

[45] Apr. 28, 1981

[54] COAL COATING METHOD

[75] Inventors: Alexander J. Shaw; Bruce H. Levelton, both of Vancouver, Canada

[73] Assignee: Kaiser Resources, Ltd., Vancouver, Canada

[21] Appl. No.: 51,614

[22] Filed: Jun. 25, 1979

[51] Int. Cl.[3] ..... C10L 5/32

[52] U.S. Cl. ..... 44/6

[58] Field of Search ..... 44/6, 1 R

[56] References Cited

U.S. PATENT DOCUMENTS

| | | | |
|---|---|---|---|
| 1,922,391 | 8/1933 | Odell | 44/6 |
| 1,960,917 | 5/1934 | Nagelvooet | 44/6 |
| 2,125,753 | 8/1938 | Spencer | 44/6 |
| 2,176,128 | 10/1939 | Fife | 44/6 |
| 2,176,129 | 10/1939 | Fife | 44/6 |
| 2,448,605 | 9/1948 | Kleinicke | 44/6 X |
| 2,621,115 | 12/1952 | Van Order | 44/6 |
| 2,854,347 | 9/1958 | Booth et al. | 117/6 |
| 3,069,293 | 12/1962 | Booth | 44/6 X |

*Primary Examiner*—Carl F. Dees

*Attorney, Agent, or Firm*—Naylor, Neal & Uilkema

[57] ABSTRACT

Bulk coal, i.e. coal in coal cars, in piles, in bins, in ships, or in any other place where coal fines tend to become entrained in ambient air, is protectively coated to prevent the loss of coal fines. The coal is first coated with a wetting agent and then coated with an emulsion of crude coal tar in water containing a cationic emulsifying agent.

6 Claims, No Drawings

COAL COATING METHOD

SUMMARY OF THE INVENTION

The essential object of the invention is to cover the otherwise exposed surface of bulk or piled-up coal with a flexible, water resistant and force resistant blanket of coal tar in a solid condition. This is accomplished by essentially a two step operation in which the exposed surface of the coal is pre-wetted with a wetting agent and in which immediately thereafter the coal tar emulsion is applied to the coal. The wetting agent enables the subsequently applied emulsion to rapidly wet the coal, form a continuous film thereover, and to then break to set up a solid but flexible sealing layer over the coal which is essentially water resistant and which will withstand substantial mechanical abuse such as that imparted by a moving coal car.

The underlying object of the invention is to prevent the present substantial economic losses of coal dust and coal fines to ambient air.

Other objects and advantages of the invention are as follows: to provide a low cost coal coating process employing low cost materials; to provide a coal coating material which may be readily pumped, stored for extended periods without change, and applied readily through spray nozzles and the like; to provide a coal coating material which forms a strong flexible layer on the coal granules and particles which is able to withstand vibration and to retain moisture in the coal; to provide a coal coating material which is insoluble in water after its application; to provide a coal coating material which becomes immediately stable upon application; and to provide a coal coating material which will break up reasonably well when a coal car is dumped.

These and other objects and advantages of the invention will be apparent from the following description of the invention.

The preferred coal tar for the present process is the crude coal tar produced from medium-volatile Balmer coal in a horizontal retort coke oven. This tar has a relatively low cost and is a semi-fluid material as produced. It emulsifies well with water when a cationic emulsifying agent is employed. A wide variety of such cationic emulsifying agents may be satisfactorily employed in the coating material of the invention, i.e.

(a) Long chain aliphatic diamine quaternary ammonium compounds.

(b) Alkyl trimethyl quaternary ammonium compounds.

(c) Alkyl propylene diamines.

(d) N-alkyl trimethylene diamine polyoxyethylene compounds.

The preferred type of such agent is a fatty amine agent such as E-11, a long chain aliphatic diamine quaternary ammonium formulation. E-11 is a product of Armour.

The basic stock material is made up by mixing 40–70% by weight of crude coal tar, 60–30% by weight of water, and 0.5–2.0% based on total emulsion volume of the cationic emulsifying agent. A 50-50 tar-water mix with 1.7% of the agent is preferred. The emulsion can be made with a continuous homogenizer when the water containing the emulsifying agent and tar are fed separately to the shear zone. Good emulsions may also be obtained by using batch homogenizers of various types.

The emulsion by itself will wet the coal, but somewhat slowly, and since less than one minute is available for a binder to be applied to and adsorbed by the coal surface (the time within which it should be possible to spray-coat a loaded coal car passing beneath a spray head) it is desirable to make use of a wetting agent which permits rapid contact of the emulsion with the coal. In addition the type of coating formed by using the emulsion by itself does not perform well as a dust suppressant.

For this purpose, any wetting agent may be employed which has the properties of wetting the coal, promoting the formation of a full-covering film of the emulsion on the coal.

Cationic emulsions break on contact with a surface. It was not to be expected that the presence of a water solution of a non-ionic wetting agent would affect the quality of the coat tar surface formed.

Surfactants which may be used as wetting agents for the coal in the coating process of the invention are as follows:

1. Nonionic
   (a) Alkylphenyl-polyethoxy ethers.
   (b) Alkyl polyethoxy ethers.
   (c) N, N-substituted fatty acid amides.
2. Anionic
   (a) Alkyl aryl sulfonates.
   (b) Alkane sulfonates.
   (c) Alkyl sulfonates with an amide intermediate linkage.
3. Cationic
   (a) Tetra-alkyl ammonium salts with at least one long chain alkyl group.
   (b) Polyethoxy alkyl amines.
   (c) Dialkyl-aminoalkyl fatty acid amide.

The preferred wetting agents are the non-ionic alkylphenyl polyethoxy ethers. Typically, a 0.03% by weight solution of such an ether, in water is employed.

Taking a typical loaded coal car as a working example of the practice of the process of the invention, the surface of the coal is first pre-wetted with about 24 U.S. gallons of water containing 0.03% of an alkylphenyl-polyethoxy ether. Immediately thereafter about 12 gallons of the coal tar emulsion are sprayed on the coal. If desired, a second application of the tar emulsion may be made.

The result of this application of the tar emulsion is the formation on the coal of a surface layer about 0.75 inches thick made up of coal particles and coal dust bonded with coal tar. This layer is flexible and withstands mechanical abuse of the magnitude encountered by heavily handled loaded coal cars. Immediately after the application of the emulsion to the coal, the emulsion breaks to set up a solid but flexible sealing layer over the coal, and thereafter this layer is essentially water resistant and remains in place as a cover after being subjected to wind, weather and vibration in a travelling rail car.

What is claimed is:

1. A process for suppressing the entrainment into ambient air of coal fines from the exposed surface of bulk coal comprising applying to said surface a dilute aqueous solution of a wetting agent and thereafter applying to said surface an emulsion of coal tar in water as soon as said aqueous solution has been absorbed thereby, said aqueous solution having the capabilities of promoting the wetting of the coal by the coal tar emulsion and enhancing the dust suppressant properties of the surface layer formed by the coal tar after the breaking of the emulsion.

2. The process of claim 1 wherein said emulsion contains 40–70% by weight of coal tar, 60–30% by weight of water and 0.5–2.0% by volume of a cationic emulsifying agent.

3. The process of claim 1 wherein wetting agent being a non-ionic alkylphenyl polyethoxy ether.

4. The process of claim 1 wherein said wetting agent being present to the extent of about 0.03% by weight of said solution.

5. The process of claim 4 wherein said emulsifying agent is cationic and is a long chain aliphatic diamine quaternary ammonium compound.

6. The process of claim 1 wherein said emulsion of coal tar in water is applied to said surface less than one minute after said aqueous solution has been applied thereto.

* * * * *